US009543130B2

(12) United States Patent
Mackay

(10) Patent No.: US 9,543,130 B2
(45) Date of Patent: Jan. 10, 2017

(54) PHOTOMULTIPLIER TUBE (PMT) HAVING A REFLECTIVE PHOTOCATHODE ARRAY

(71) Applicant: KLA-Tencor Corporation, Milpitas, CA (US)

(72) Inventor: Derek Cameron Mackay, Menlo Park, CA (US)

(73) Assignee: KLA-Tencor Corporation, Milpitas, CA (US)

( * ) Notice: Subject to any disclaimer, the term of this patent is extended or adjusted under 35 U.S.C. 154(b) by 0 days.

(21) Appl. No.: 14/934,107

(22) Filed: Nov. 5, 2015

(65) Prior Publication Data

US 2016/0141161 A1 May 19, 2016

Related U.S. Application Data

(60) Provisional application No. 62/079,985, filed on Nov. 14, 2014.

(51) Int. Cl.
*H01J 43/18* (2006.01)
*H01J 43/10* (2006.01)
*H01J 43/08* (2006.01)

(52) U.S. Cl.
CPC ..... *H01J 43/10* (2013.01); *H01J 43/08* (2013.01); *H01J 43/18* (2013.01)

(58) Field of Classification Search
CPC ..... H01J 43/28; H01J 1/34; H01J 31/36
USPC ..... 313/532, 533
See application file for complete search history.

(56) References Cited

U.S. PATENT DOCUMENTS 5,336,967 A 8/1994 Tomasetti et al.
5,561,347 A * 10/1996 Nakamura ..... H01J 43/06 313/532
2010/0253218 A1 10/2010 Yamashita et al.
2012/0091890 A1 4/2012 Shimoi et al.
2013/0126705 A1 5/2013 Maleev

FOREIGN PATENT DOCUMENTS

JP 2010257962 A 11/2010

OTHER PUBLICATIONS

International Search Report from International Application No. PCT/US2015/060699, dated Mar. 31, 2016.
Hamamatsu, "Photomultiplier Tubes; Photomultiplier Tubes and Related Products," Nov. 2010, pp. 1-138, retrieved from www.hamamatsu.com/resources/pdf/eld/PMT_TPMZ0002E.pdf.

* cited by examiner

*Primary Examiner* — Vip Patel
(74) *Attorney, Agent, or Firm* — Zilka-Kotab, PC

(57) ABSTRACT

An internal portion of a photomultiplier tube (PMT) having a reflective photocathode array, and a method for manufacturing the same, are provided. The internal portion of the PMT comprises the reflective photocathode array and at least one dynode structure corresponding to the array of reflective photocathodes. Each reflective photocathode receives light and from the light, generates photoelectrons which then travel towards the at least one dynode structure. Upon the photoelectrons making contact with the at least one dynode structure, the photoelectrons are multiplied.

22 Claims, 5 Drawing Sheets

PHOTOMULTIPLIER TUBE (PMT) HAVING A REFLECTIVE PHOTOCATHODE ARRAY

RELATED APPLICATION(S)

This application claims the benefit of U.S. Provisional Patent Application No. 62/079,985 filed Nov. 14, 2014, the entire contents of which are incorporated herein by reference.

FIELD OF THE INVENTION

The present invention relates to photomultiplier tubes (PMTs).

BACKGROUND

Photomultiplier tubes (PMTs) are devices utilized to detect light. They convert light to photoelectrons that are then multiplied and detected. In the past, one particular type of PMT has been formed from a transmission photocathode and a chain of dynodes. An example of the internal structure of a PMT in accordance with the prior art is shown in FIG. 1. As shown in FIG. 1, light 102 makes contact with one side of a transparent photocathode 104 and as a result photoelectrons 106 are emitted from the other side of the transparent photocathode 104. The photoelectrons 106 then make contact with a dynode structure 108 which in turn multiplies the photoelectrons 106.

Unfortunately, prior art PMTs (such as that illustrated in FIG. 1) have exhibited various limitations. For example, use of a transmission photocathode, as compared to a reflective photocathode, generally results in lower quantum efficiency and a shorter useful lifetime. However, the use of reflective photocathodes has sometimes been avoided in PMT devices for mainly geometric reasons (for instance, needing to have a compact PMT in order to have high bandwidth).

There is thus a need for addressing these and/or other issues associated with the prior art PMTs.

SUMMARY

An internal portion of a photomultiplier tube (PMT) having a reflective photocathode array, and a method for manufacturing the same, are provided. The internal portion of the PMT comprises the reflective photocathode array and at least one dynode structure corresponding to the array of reflective photocathodes. Each reflective photocathode receives light and from the light, generates photoelectrons which then travel towards the at least one dynode structure. Upon the photoelectrons making contact with the at least one dynode structure, the photoelectrons are multiplied.

DETAILED DESCRIPTION

Figure 2:
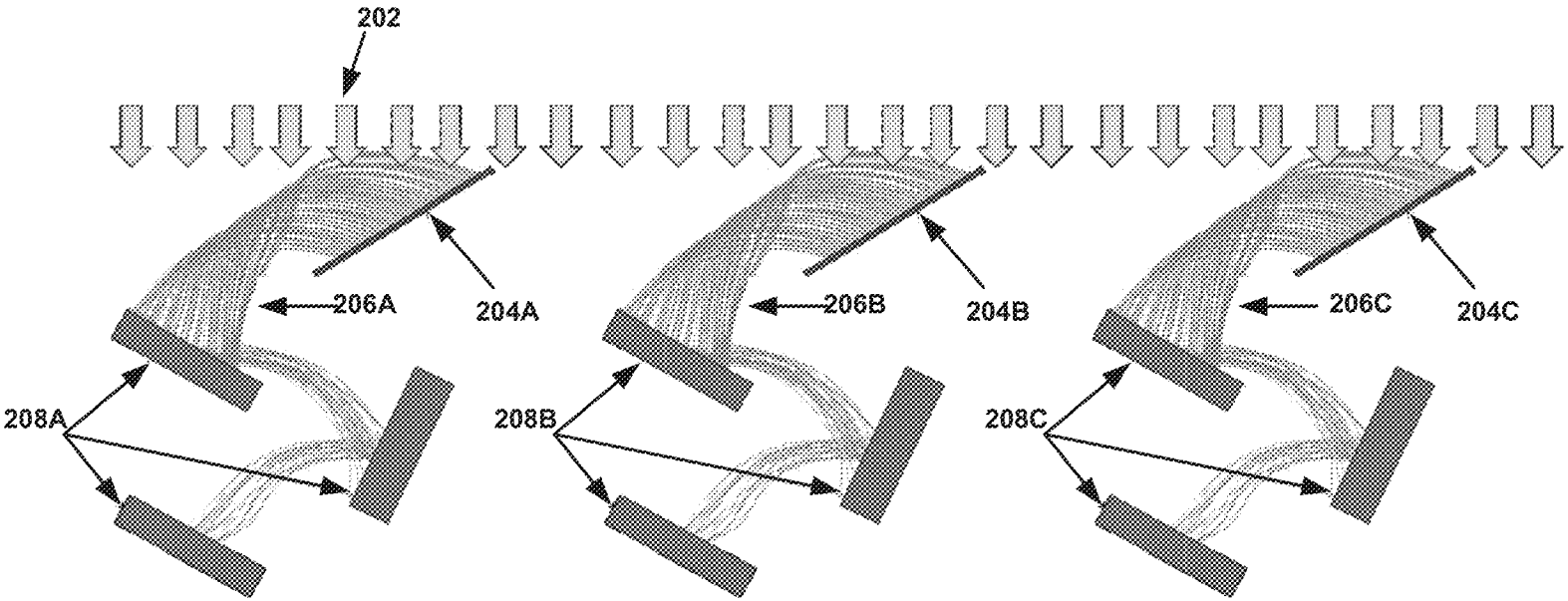
FIG. 2 shows an internal portion of a PMT having a reflective photocathode array, in accordance with an embodiment.

FIG. 2 shows an internal portion of a PMT having a reflective photocathode array, in accordance with an embodiment. As shown, the internal portion of the PMT includes a reflective photocathode array 204A-C where each of the reflective photocathodes 204A-C are for receiving light 202 and where photoelectrons 206A-C are generated from the received light 202 by the reflective photocathodes 204A-C. The internal portion of the PMT further includes at least one dynode structure corresponding to the array of reflective photocathodes 204A-C for multiplying the photoelectrons 206A-C generated by the array of reflective photocathodes 204A-C.

In the embodiment shown, a separate dynode structure 208A-C corresponds to each of the reflective photocathodes 204A-C for multiplying the photoelectrons 206A-C generated by the corresponding reflective photocathode 204A-C. In another contemplated embodiment (not shown), a single dynode structure may correspond to multiple of (e.g. all of) the reflective photocathodes 204A-C in the array for multiplying the photoelectrons 206A-C generated by the entire reflective photocathode 204A-C array. Of course, the PMT may also include other sub-structures as is known in the art.

Gaps are provided between the reflective photocathodes 204A-C in order to allow the photoelectrons 206A-C from each of the reflective photocathodes 204A-C to pass through to the dynode structure 208A-C. It should also be noted that while only three sub-structures comprising a reflective photocathode and corresponding dynode structure are shown in the array (i.e. sub-structure 204A and 208A, sub-structure 204B and 208B, sub-structure 204C and 208C), any number of such sub-structures may be included within the PMT, as desired. In other embodiments, the array of reflective photocathodes 204A-C may be any number larger than one, and the reflective photocathodes 204A-C may be utilized in combination with any number of dynode structures 208A-C (i.e. one or more).

Each reflective photocathode 204A-C may be positioned at an angle within the PMT, so as to send the photoelectrons 206A-C towards the dynode structure 208A-C. Further, each dynode structure 208A-C may be at a position within the PMT to be able to receive the photoelectrons 206A-C from the corresponding reflective photocathode(s) 204A-C. In an embodiment with the aforementioned sub-structures, each of the sub-structures within the PMT comprising the reflective photocathode 204A-C and corresponding dynode structure 208A-C may be identical (e.g. in position, material, etc.).

It should be noted that each reflective photocathode 204A-C may be any photocathode with at least a reflective top surface capable of reflecting photoelectrons the 206 A-C from the light 202 that is incident thereto. For example, the reflective photocathode 204 A-C may be any existing reflective photocathode known in the art.

Further, each dynode structure 208A-C may include a plurality of dynodes, each capable of multiplying photoelectrons received thereby. For example, the dynodes may be positioned in a chain for passing the photoelectrons 206A-C therebetween. Again, the dynode structure 208A-C may be that which is well known in the art with regard to PMTs.

Figure 1:
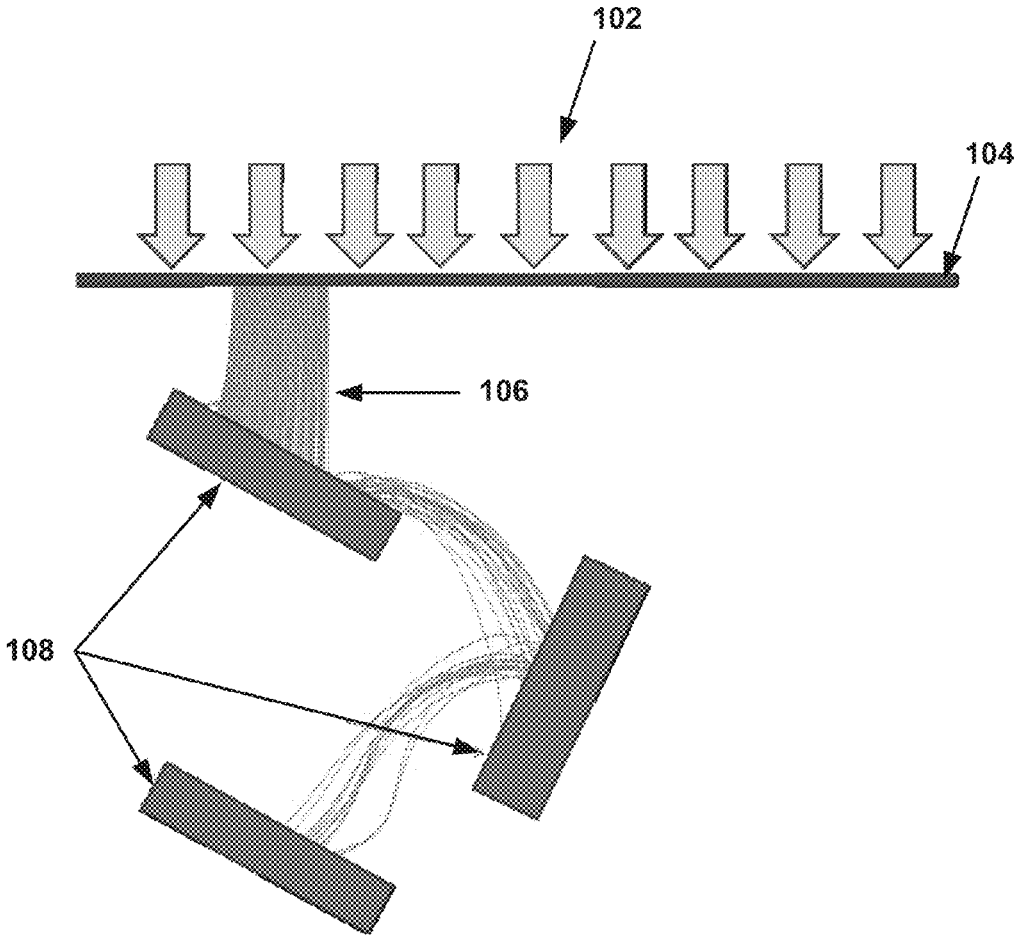
Figure 1 (PRIOR ART)
FIG. 1 shows an internal portion of a photomultiplier tube (PMT) having a transparent photocathode, in accordance with the prior art.

By using the reflective photocathode array 204A-C in the PMT, higher quantum efficiency may be provided (than that provided by the transparent photocathodes used in the prior art, as shown in FIG. 1 for example), particularly because the reflective property of the reflective photocathodes 204A-C allows for more photoelectrons 206A-C to be captured from the light 202 and transmitted to the dynode structure 208A-C than amount of the photoelectrons otherwise captured and emitted by the transparent photocathode of the prior art).

Furthermore, the reflective photocathode 204A-C is capable of being formed from a more robust material than the traditional transparent photocathode. In particular, the reflective photocathode 204A-C may be formed from any desired material that is then coated with a reflective surface. This may accordingly increase the lifetime of the PMT when the PMT includes the reflective photocathode 204A-C as described in the present embodiment, as opposed to the prior art PMT having the transparent photocathode.

More illustrative information will now be set forth regarding various optional architectures and features with which the foregoing framework may or may not be implemented, per the desires of the user. It should be strongly noted that the following information is set forth for illustrative purposes and should not be construed as limiting in any manner. Any of the following features may be optionally incorporated with or without the exclusion of other features described.

Figure 3A:
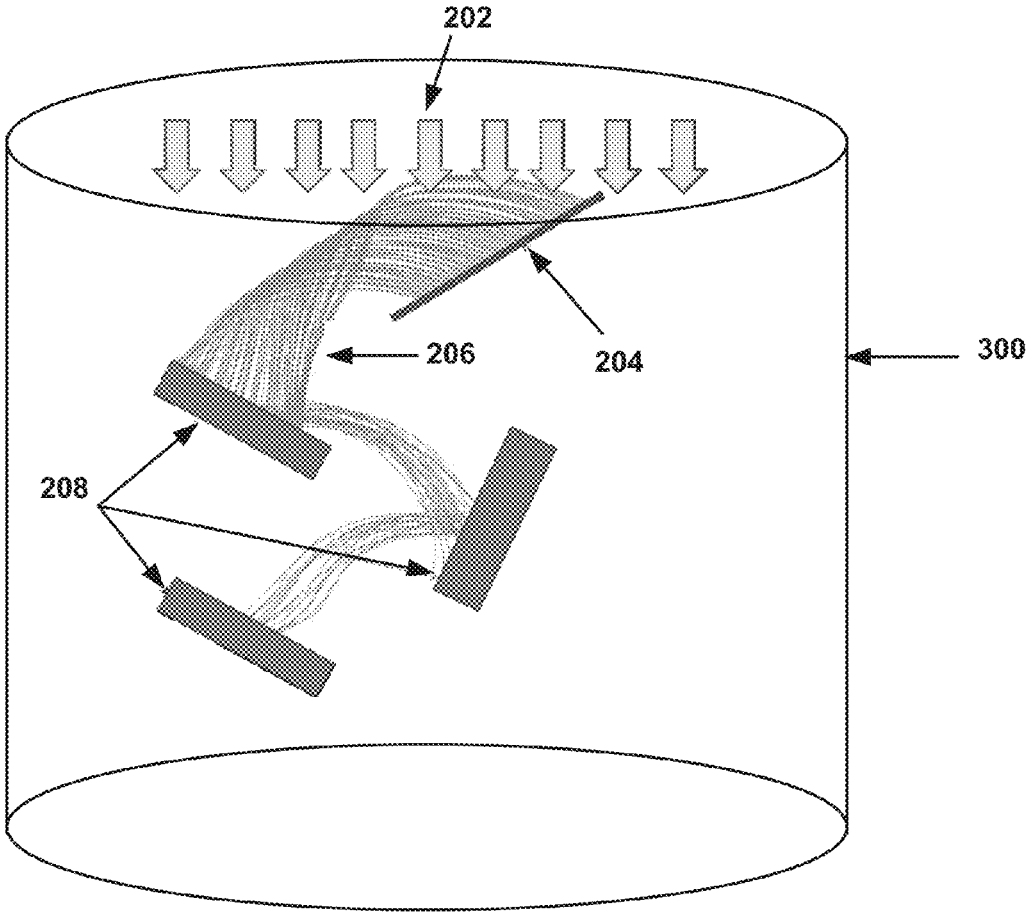
FIG. 3A illustrates a reflective photocathode/dynode substructure of the PMT of FIG. 2 having a housing with light incident head-on, in accordance with an embodiment.

FIG. 3A illustrates a reflective photocathode/dynode substructure of the PMT of FIG. 2 having a housing with light incident head-on, in accordance with an embodiment. While only one sub-structure comprising a single reflective photocathode 204 and corresponding dynode structure 208 is shown within the housing 300, it should be noted that the context of the present description the housing 300 would enclose the array of reflective photocathodes 204A-C and corresponding dynode structure(s) 208A-C as described above with respect to FIG. 2.

As shown, the reflective photocathode 204 and the dynode structure 208 are included within the housing 300. The housing 300 may be a tube or any other enclosed structure as is known in the art with respect to PMTs. Additionally, the reflective photocathode 204 is positioned at a diagonal angle from an end side of the housing 300. The end side of the housing may be, at least in a part, a window through which the light 202 can pass. In the embodiment shown, the light 202 is directed perpendicularly to the end side of the housing 300 and is incident with the reflective photocathode 204 at an angle. In this case, the PMT may be considered a head-on PMT.

Figure 3B:
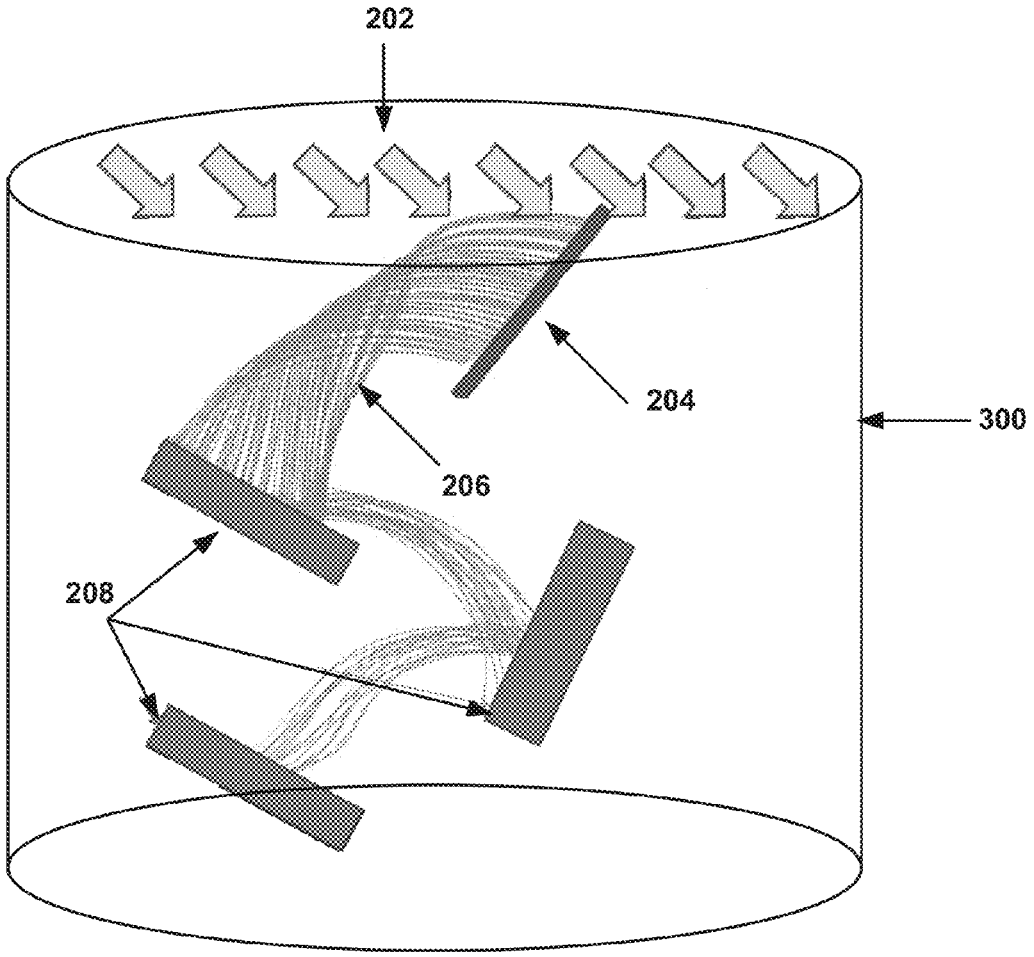
FIG. 3B illustrates a reflective photocathode/dynode substructure of the PMT of FIG. 2 having a housing with light incident at an angle, in accordance with an embodiment.

FIG. 3B illustrates a reflective photocathode/dynode substructure of the PMT of FIG. 2 having a housing with light incident at an angle, in accordance with an embodiment. Again, while only one sub-structure comprising a single reflective photocathode 204 and corresponding dynode structure 208 is shown within the housing 300, it should be noted that the context of the present description the housing 300 would enclose the array of reflective photocathodes 204A-C and corresponding dynode structure(s) 208A-C as described above with respect to FIG. 2.

As shown, the reflective photocathode 204 and the dynode structure 208 are included within the housing 300. The housing 300 may be a tube or any other enclosed structure as is known in the art with respect to PMTs. Additionally, the reflective photocathode 204 is positioned at a diagonal angle from an end side of the housing 300. The end side of the housing may be, at least in a part, a window through which the light 202 can pass. In the embodiment shown, the light 202 may be directed toward the end side of the housing 300 at an angle and is perpendicularly incident with the reflective photocathode 204, in which case the PMT may not be considered a head-on nor a side-on PMT. As an option, the end side of the housing 300 and window included therein may be positioned such that it is perpendicular to the incident light in order to minimize reflection resulting from the window (not shown).

To this end, the light can be incident, at an angle, to the array of reflective photocathodes shown in FIG. 2, or in another embodiment can be perpendicularly incident to the array of reflective photocathodes shown in FIG. 2. Optionally, the angle at which the reflective photocathode 204 is positioned within the housing 300 may differ depending on whether the light is incident at an angle with respect to the array of reflective photocathodes (as in the embodiment shown in FIG. 3A) or is incident perpendicular to the array of reflective photocathodes (as in the embodiment shown in FIG. 3B).

Figure 4:
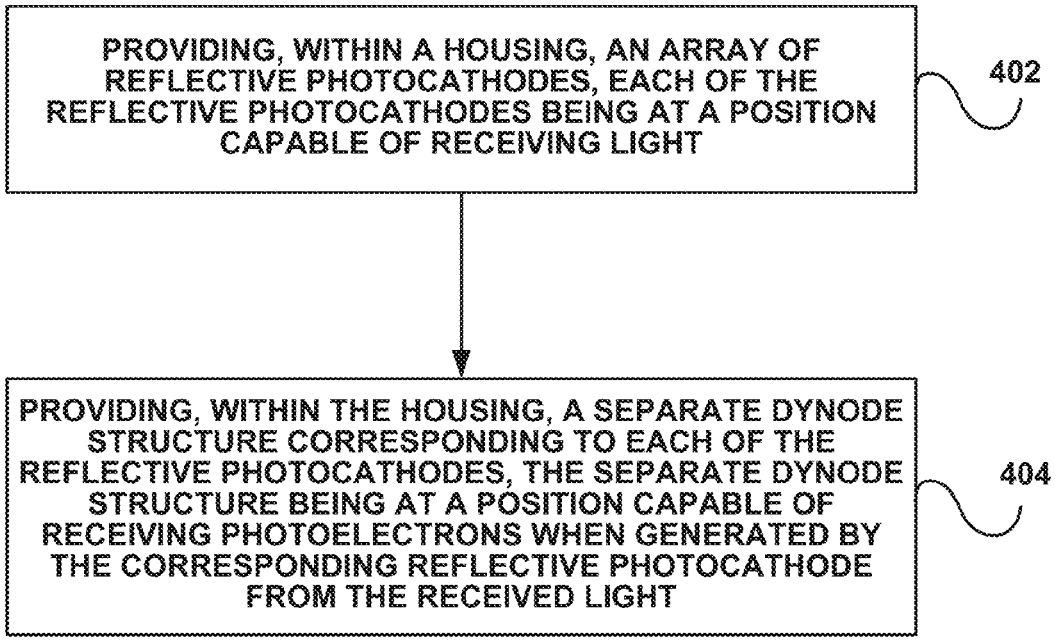
FIG. 4 illustrates a method for manufacturing an internal portion of a PMT having a reflective photocathode array, in accordance with an embodiment.

FIG. 4 illustrates a method for manufacturing an internal portion of a PMT having a reflective photocathode array, in accordance with an embodiment. It should be noted that the present method described in FIG. 4 may be implemented in the context of the aforementioned figures and associated descriptions.

The method includes, in operation 402, providing, within a housing, an array of reflective photocathodes, each of the reflective photocathodes being at a position capable of receiving light. The method further includes, in operation 404, providing, within the housing, at least one dynode structure corresponding to the array of reflective photocathodes, the at least one dynode structure being at a position capable of receiving photoelectrons when generated by the array of reflective photocathodes from the received light.

While various embodiments have been described above, it should be understood that they have been presented by way of example only, and not limitation. Thus, the breadth and scope of a preferred embodiment should not be limited by any of the above-described exemplary embodiments, but should be defined only in accordance with the following claims and their equivalents.

What is claimed is:

1. A head-on photomultiplier tube (PMT), comprising:

a housing having a top end with a window, two lateral sides, and a bottom end;

an array of reflective photocathodes within the housing, each of the reflective photocathodes for receiving light entering the housing through the window of the top end of the housing, and for generating photoelectrons from the received light; and at least one dynode structure within the housing and corresponding to the array of reflective photocathodes for multiplying the photoelectrons generated by the corresponding array of reflective photocathodes.

2. The head-on PMT of claim 1, wherein the housing is a tube.

3. The head-on PMT of claim 1, wherein each of the reflective photocathodes is positioned at a diagonal angle from the top end of the housing.

4. The head-on PMT of claim 1, wherein each of the at least one dynode structure includes a plurality of dynodes.

5. The head-on PMT of claim 4, wherein the dynodes are positioned in a chain for passing the photoelectrons therebetween.

6. The head-on PMT of claim 4, wherein each of the dynodes multiplies photoelectrons received thereby.

7. The head-on PMT of claim 1, wherein the at least one dynode structure includes a single dynode structure that correspond to multiple of the reflective photocathodes in the array.

8. The head-on PMT of claim 7, wherein the single dynode structure corresponds to all of the reflective photocathodes in the array.

9. The head-on PMT of claim 1, wherein the at least one dynode structure includes a separate dynode structure corresponding each of the reflective photocathodes in the array.

10. The head-on PMT of claim 1, wherein the light is one of:

incident to the array of reflective photocathodes at an angle, and perpendicularly incident to the array of reflective photocathodes.

11. The head-on PMT of claim 10, wherein:

when the light is incident to the array of reflective photocathodes at the angle then each of the reflective photocathodes is situated at a first angle, and when the light is perpendicularly incident to the array of reflective photocathodes then each of the reflective photocathodes is situated at a second angle that is different from the first angle.

12. A method for manufacturing a head-on photomultiplier tube (PMT), comprising:

configuring, within a housing having a top end with a window, two lateral sides, and a bottom end, an array of reflective photocathodes, each of the reflective photocathodes being at a position capable of receiving light entering the housing through the window of the top end of the housing; and providing, within the housing, at least one dynode structure corresponding to the array of reflective photocathodes, the at least one dynode structure being at a position capable of receiving photoelectrons when generated by the corresponding array of reflective photocathodes from the received light.

13. The method of claim 12, wherein the housing is a tube.

14. The method of claim 12, wherein each of the reflective photocathodes is positioned at a diagonal angle from top end of the housing.

15. The method of claim 12, wherein each of the dynode structures includes a plurality of dynodes.

16. The method of claim 15, wherein the dynodes are positioned in a chain for passing the photoelectrons therebetween.

17. The method of claim 15, wherein each of the dynodes multiples photoelectrons received thereby.

18. The method of claim 12, wherein the light is one of:

incident to the array of reflective photocathodes at an angle, and perpendicularly incident to the array of reflective photocathodes.

19. The method of claim 18, wherein:

when the light is incident to the array of reflective photocathodes at the angle then each of the reflective photocathodes is situated at a first angle, and when the light is perpendicularly incident to the array of reflective photocathodes then each of the reflective photocathodes is situated is situated at a second angle that is different from the first angle.

20. The method of claim 12, wherein the at least one dynode structure includes a single dynode structure that correspond to multiple of the reflective photocathodes in the array.

21. The method of claim 10, wherein the single dynode structure corresponds to all of the reflective photocathodes in the array.

22. The method of claim 12, wherein the at least one dynode structure includes a separate dynode structure corresponding each of the reflective photocathodes in the array.

* * * * *